US006790059B2

(12) United States Patent
Poehlau

(10) Patent No.: US 6,790,059 B2
(45) Date of Patent: Sep. 14, 2004

(54) ELECTRIC BUS BAR, THE USE THEREOF AND A METHOD FOR PRODUCING THE SAME

(75) Inventor: Frank Poehlau, Fuerth (DE)

(73) Assignee: Oechsler Aktiengesellschaft, Ansbach (DE)

( * ) Notice: Subject to any disclaimer, the term of this patent is extended or adjusted under 35 U.S.C. 154(b) by 0 days.

(21) Appl. No.: 10/381,876

(22) PCT Filed: Jul. 27, 2001

(86) PCT No.: PCT/EP01/08685

§ 371 (c)(1),
(2), (4) Date: Aug. 27, 2003

(87) PCT Pub. No.: WO02/29939

PCT Pub. Date: Apr. 11, 2002

(65) Prior Publication Data

US 2004/0038567 A1 Feb. 26, 2004

(30) Foreign Application Priority Data

Sep. 30, 2000 (DE) ..... 100 48 680

(51) Int. Cl.[7] ..... H01R 25/00
(52) U.S. Cl. ..... 439/110
(58) Field of Search ..... 439/110, 120; 29/846, 848

(56) References Cited

U.S. PATENT DOCUMENTS 5,399,094 A 3/1995 Korth et al.
5,418,328 A * 5/1995 Nadeau ..... 174/48
5,664,953 A * 9/1997 Reylek ..... 439/111
5,833,358 A * 11/1998 Patik ..... 362/391
5,950,305 A * 9/1999 Roberts ..... 29/848
5,976,391 A * 11/1999 Belke et al. ..... 216/13
6,017,251 A * 1/2000 Rittmann ..... 439/716
6,113,248 A * 9/2000 Mistopoulos et al. ..... 362/240
6,445,571 B1 * 9/2002 Inniss et al. ..... 361/624
6,644,988 B2 * 11/2003 Healy ..... 439/120
6,688,898 B2 * 2/2004 Nisimoto et al. ..... 439/164
2003/0157819 A1 * 8/2003 Healy ..... 439/110
2004/0055153 A1 * 3/2004 Zahradnik et al. ..... 29/846

FOREIGN PATENT DOCUMENTS

DE 198 23 598 11/1999

* cited by examiner

*Primary Examiner*—Ross Gushi
(74) *Attorney, Agent, or Firm*—Burns, Doane, Swecker & Mathis, L.L.P.

(57) ABSTRACT

An electric bus bar for low to medium current magnitudes is produced by co-extruding a support structure and a plurality of strips embedded therein. The material of the support structure is plastic and non-electroplatable, whereas the material of the strip is plastic and electroplatable. After a one-piece support element comprising the support structure and the strips has been formed by the co-extrusion step, exposed surfaces of the strips are electroplated with an electrically conductive material.

15 Claims, 1 Drawing Sheet

ELECTRIC BUS BAR, THE USE THEREOF AND A METHOD FOR PRODUCING THE SAME

BACKGROUND OF THE INVENTION

The invention relates to an electric bus bar, its particular possibilities of use and a method for producing the same.

An electric bus bar, known from patent DE 43 08 735 C1, (corresponding to U.S. Pat. No. 5,399,094), comprises a mechanically and electrically shielded conductive track along which a sliding contact may be placed for undisturbed pick-up of data regardless of the electromagnetic interference-rich surroundings. For this purpose, a metal strip accessible on its surface is embedded in the longitudinal channel of an extruded plastic strip whereby a metal mesh is sealed into said plastic strip along its entire length and width for electrical shielding. The thusly assembled plastic strip is then bent into a C-configuration around the metal strip disposed inside and said C-configuration is subsequently forced radially into a C-shaped support profile made of synthetic material. In fact, the C-configuration expands elastically to some degree but its longitudinal edges form thereby sealing lips to close the radial C-slot along which the longitudinal edges of the metal mesh make contact, if they are not spread out locally by the sliding contact engaging here the metal strip in a radial manner. The support profile, which receives at its inner area the C-configuration of the plastic strip equipped with the metal strip, may be designed to have longitudinally-extending ribs on the outside whose front edges are equipped with E-shaped caps (in cross section) to serve as electric conductors for parallel energy supply.

However, traditional bus bars—making energy available—consist usually of a support body or yoke that is U-shaped in cross section onto which yoke there are contactable conductors inserted on the inside (meaning between the lateral raised legs) in the form of profiled metal tracks or massive blank wires (without insulation)—or said support body is held in place on the yoke between pegs disposed at a distance apart or between through-running ribs. Such conductors may furnish electric power of considerable magnitudes to the adapters based on their type of cross section, which are selectively and detachably attachable again to the conductors along the support body with non-positive or positive fit to feed light fixtures or (electric) supply outlets. However, the installation and the one-piece production of the conductor is rather costly and labor-intensive from a manufacturing and technical view. Oftentimes, the conductors do not require such large cross-sectional dimensions at all, as in signal nets or data nets, for example, but equipping the pre-manufactured support body profile later on with reliably-contacting thin wires is even more labor intensive.

In recognition of these circumstances, the present invention has as its technical object to achieve an electric conductor structure for bus bars which are easy to manufacture and which are not limited, in particular, to the traditional kind of bus bars but which can be employed universally.

SUMMARY OF THE INVENTION

This object is achieved according to the invention a conductor structure employable as a bus bar which comprises an extrusion structure made of plastic profiles combined with one another that can or cannot be metallized (electroplated) and which are produced directly in a common extrusion process as support bodies that cannot be metallized having conductor strips embedded therein that can be metallized. The here so-called conductor strips are not electric conductors at first, but they become electric conductors through metallizing of the outer surfaces that are exposed on the surface of the support body. There is great freedom given in the design of the cross-sectional geometry. For instance, the conductor strip could be in the form of longitudinal ribs on a core encased by a support body that cannot be metallized whereby said core penetrates with said ribs the casing in a cross-sectional star-like manner into the plane of the outer surface of said casing. The core of the conductor strip may also be hollow for constructional reasons, or to save material, or to be of lighter weight, and the inner surface of the casing can thereby be additionally metallized. This metallized coating may thereby be disposed in circumferential direction and can be insulated against one another and extend sectional in the form of strips parallel to the core axis of the conductors so that the support body, which means the casing that cannot be metallized, also penetrates in the form of ribs to the inner surface of the hollow core.

These profiles may be employed as traditional bus bars for lighting or data transmission requirements, for example. However, unconventional uses are of more interest economically, as for dual use to a certain extent, such as shielded and here externally accessible transmission of sensor information and control data along the inner surface of a tube used as a medium channel, for instance—or being used inconspicuously in the interior angle area of cross-sectional convex covers used as building material, along support columns and crossheads in standard building installation, or in modular units having traditionally equipped cable channels.

For the purpose of metallizing the exposed surfaces of the conductor strips, the thusly combined exposed extrusion structure can be treated in a single operation in a continuous electroplating process, while piece goods, for example, are electroplated piece by piece in the traditional manner. During the electroplating process, electric-conductive metallization occurs only next to the surfaces of the conductor strips that cannot be electroplated (which means, an exposed area of the conductor next to the electric insulated surroundings), which represents therefore the electric conductive structure.

A conductor structure, which is suitable as an electric bus bar for low to medium current magnitudes, can be produced in an extremely cost-effective manner by a multi-component extrusion process whereby a support body is extruded that is made of electric insulating thermoplastic synthetic material which cannot be metallized and which has continuous conductor strips embedded made of thermoplastic synthetic material that can be metallized, in contrast; whereby there are inevitably and selectively metallized for carrying current (by way of electroplating) only the surfaces of the conductor strips that are exposed from the insulating surroundings of the support body, whereby ohmic contact can be made with said surfaces of the conductor strip by means of adapters, for instance.

BRIEF DESCRIPTION OF DRAWINGS

For a more detailed explanation of the invention, see the object according to the invention and the subsequent description of the sketched drawings of the preferred embodiments, whereby the drawings are not drawn exactly to scale to show the essentials in a cross-sectional view.

DESCRIPTION OF PREFERRED EMBODIMENTS OF INVENTION

Figure 1:
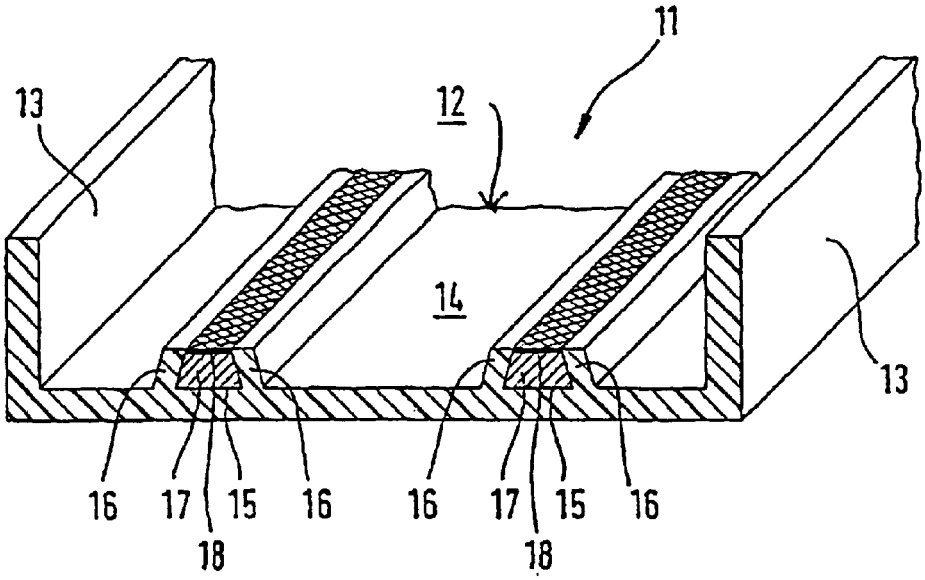
FIG. 1 shows in a perspective, sectional fractional view the cross-sectional front end of one embodiment of a bus bar according to the invention that is extruded in one piece, complete with two conductor strips in the classic trough-shaped (U-shaped) design.

The conductor structure illustrated in FIG. 1 has the traditional approximately U-shaped or trough-shaped profile in cross section of an electric-insulating support body 12 of a bus bar 11. On its inside, which means on the base 14 connecting the sides 13 (to form a yoke), there are grooves 15 formed extending parallel to one another and extending in longitudinal direction of the bus bar 11 whereby said grooves 15 can be embedded in the base 14 and encased by longitudinal ribs 16 extruded thereon as illustrated. While the preferable one-piece extruded support body 12 is made of thermoplastic synthetic material, such as "polyamide 12", liquid crystal polymer (LCP) or polybutylenterephtalat (PBT), whose surfaces can practically no longer be metallized by electroplating, the grooves 15 are filled in the course of the common extrusion process with conductor strips 17 made of synthetic material such as "polyamide 6" with glass fibers or they are filled with modified LCP whereby their surfaces can be easily metallized. Electroplating occurs therefore only on accessible exposed outer surfaces running longitudinally between the ribs 16 onto which surfaces metallization 18 adheres exclusively in a solid coating during the electroplating process of the bus bar 11 subsequent to the extrusion process. Said metallized coating acts then as a continuous, mechanically contactable electric conductor in the insulating surrounding of the support body 12 that is equipped with mounting elements such as brackets, fastening hooks, or borings (not illustrated).

The object of the invention is not limited, however, to further development of the generic traditional bus bar, but it includes also any other type of conductor structures in the form of building material, extruded simultaneously and made of a plurality of materials, such as (electric) current carriers or tubing, if at least one of the extrusion components is provided with a surface which can be well metallized for the purpose of selective metallizing and which is in the insulating surroundings of at least one other extrusion material. In the scope of the present invention, there could be created therefore structural carriers of any desired cross-sectional shapes not only to be mounted externally but also for the automobile industry or machine industry in the course of the manufacturing process. Examples are shown in this regard in FIG. 2 and FIG. 3.

Figure 2:
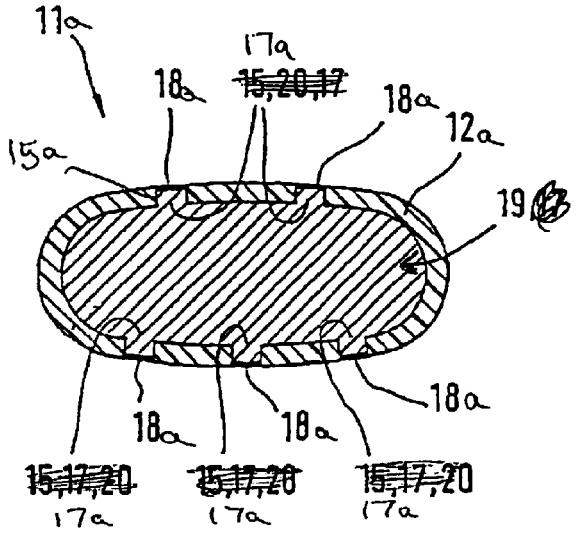
FIG. 2 shows a cross section through a second embodiment of the invention, comprised of an extruded core with conductor strips encased by a support body, oval in its cross section, together with the longitudinal ribs that are star-like and radially protruding the casing in cross section, as in this case, a five-polar electric bus bar contactable from the outside.

FIG. 2 shows an approximately oval core 19 in cross section that is encased by the support body 12*a* except for the outer surfaces of the cross-sectional, short and star-shaped projecting ribs 17*a* which project through respective slots formed in the support body. The metallizations 18*a* on the exposed outer surfaces of the ribs are therefore conductors which can be contacted from the outside (two on top and three below, in this case).

Figure 3:
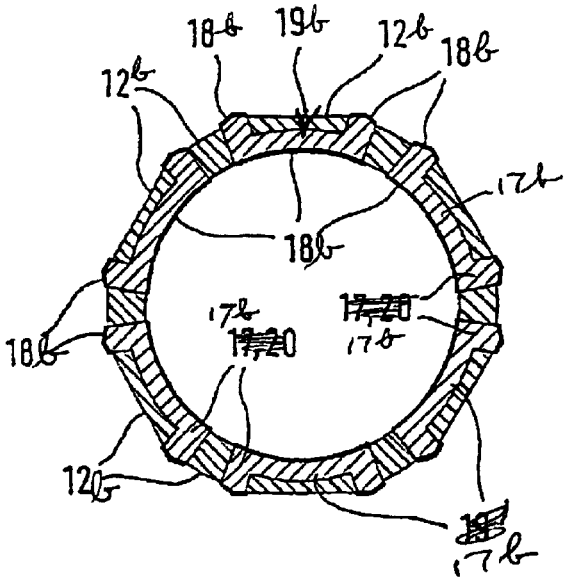
FIG. 3 shows a cross section through a third embodiment of the invention, i.e., a modification of FIG. 2, a hollow prismatic integral support structure comprising a plurality of longitudinally-extending outer and inner conductors on a plurality of parallel conductor strips between a plurality of saucer-shaped support bodies.

If the core 19*b* is hollow (as illustrated in FIG. 3), then it may not only serve as a support, such as a supporting framework construction, but also as a line for fluid, which can be electric remote-controlled, locally branched out and restricted (throttled). The electromechanical adjustment elements (such as a shutter and valves), to be inserted in the branches along the course of the pipe, can be actuated selectively via contacts to the integrated metallization 18*b*, without having to install additionally individual control lines or circulating bus lines. Such a control system is secure against malfunctions and faulty manipulation to the greatest extent, as long as only the metallizations 18*b* along the inner surface areas of the hollow core 19*b* are used for electric remote-control (which means therefore the pipe for electrically non-conductive fluids (mediums), such as the flow of heating air in this case)—similar to the circumstances considered in FIG. 3.

Correspondingly, there are provided in FIG. 3 a plurality of prismatic-edged, saucer-shaped support bodies 12*b*, and between and within said bodies there extend saucer-shaped prismatic conductor strips 17*b* as well. The saucer-shaped conductor strips 17*b*, forming collectively a hollow core 19*b*, are hereby connected together with the support bodies 12*b* to form a pipelike hollow support element in the extrusion process. In the illustrated example, said hollow support element is finally provided with two sectional, hollow cylinder-shaped inner conductors, and along the outer edges with six sectional, regular prism-shaped outer conductors, based on the surface areas of the conductor strips 17*b* that are accessible for metallization. However, the conductor structure and its individual conductor strips may also have any other desired asymmetric cross-sections, deviating from the ones in FIG. 3, such as the result of molding-on an accompanying sealing lip or a through-going mounting profile along the support body—or for a special, asymmetric cross-sectional distribution of the conductor strip, with which there can be made contact, for functional reasons, only with a matching asymmetric adapter and only in the set direction (not graphically illustrated).

In addition, material-matching (pairing) can be used in the scope of further development of the inventive solution that optimizes not only the electro-technical requirements in view of the insulation characteristics, on one hand, and, on the other hand, the conductive properties—but fulfills additionally, or in place of, other requirements, such as decorative requirements. In regard to the latter alternative, a support body 12, 12*a*, 12*b* made of relatively soft material (such as ABS=acrylonitrile-butadiene-styrene) may serve as a resilient profile, which is extruded in a single operation together with a, in contrast, hard material 17, 17*a*, 17*b* (such as TPE=thermoplastic elastomer) that can be metallized, for instance a strip that can be chromed and used as a decorative strip on the body of an automobile. Correspondingly, an inventive conductor structure of the aforementioned type may be produced, just the same, having longitudinally-extending, directly molded-on, extruded sealing lips as a three-fold co-extrudate (extruded material).

What is claimed is:

1. An electric bus bar comprising at least one support body and at least one strip co-extruded together with said at least one support body to form a one-piece extrusion element, said at least one support body formed of an electrically insulative, non-metallizable material, said at least one strip formed of an electrically insulative, metallizable material; electrically conductive metallization formed on an exposed face of said at least one strip.

2. The electric bus bar according to claim 1, where the at least one support body comprises a yoke having a base and two sides joined to said base, said at least one conductor strip disposed in a groove formed in said base between the sides, the strip extending parallel to the sides.

3. The electric bus bar according to claim 2 wherein said groove is formed by two parallel ribs upstanding from said base.

4. The electric bus bar according to claim 1 wherein said at least one strip comprises a rib forming part of a core substantially surrounded by said at least one support body, said rib projecting through a slot formed in said at least one support body.

5. The electric bus according to claim 4 wherein said at least one support body comprises a single support body, and said at least one strip comprises a plurality of strips extending through respective slots of the support body.

6. The electric bus bar according to claim 5 wherein the core is solid throughout its cross section.

7. The electric bus bar according to claim 4 wherein said core is hollow.

8. The electric bus bar according to claim 7 wherein a portion of said at least one strip is exposed at inner and outer portions thereof and is metallized on said inner and outer portions.

9. The electric bus bar according to claim 8 wherein the at least one support body comprises spaced apart support bodies, and said at least one strip comprises a plurality of circumferentially spaced strips alternating with the support bodies.

10. The electric bus bar according to claim 1 wherein said support bodies form a generally prismatically shaped profile.

11. The electric bus bar according to claim 1 wherein said at least one support body is formed of the same material as said at least one strip.

12. A method for manufacturing an electric bus bar comprising the steps of:

A) forming a one-piece extrusion element by co-extruding at least one electrically insulative, non metallizable support body together with at least one electrically insulative, metallizable strip; and B) metallizing an exposed surface of said at least one strip with an electrically conductive material.

13. The method according to claim 12 wherein step A comprises embedding the at least one strip within the at least one body.

14. The method according to claim 12 wherein step B comprises subjecting the entire extrusion element to an electroplating procedure wherein only the metallizable material becomes plated.

15. The method according to claim 12 wherein step A includes co-extruding a soft non-metallizable material along said at least one support body.

* * * * *